US005669511A

United States Patent [19]

Satake et al.

[11] Patent Number: 5,669,511

[45] Date of Patent: Sep. 23, 1997

[54] GRAIN SORTING APPARATUS

[75] Inventors: Satoru Satake, Tokyo; Yasuharu Mitoma, Higashihiroshima; Takafumi Ito, Mihara, all of Japan

[73] Assignee: Satake Corporation, Tokyo, Japan

[21] Appl. No.: 528,148

[22] Filed: Sep. 14, 1995

[30] Foreign Application Priority Data

Oct. 7, 1994 [JP] Japan ..... 6-270543

[51] Int. Cl.[6] ..... B07C 5/342

[52] U.S. Cl. ..... 209/580; 209/587; 209/707; 209/934; 198/638

[58] Field of Search ..... 209/576, 577, 209/580, 581, 582, 587, 638, 639, 642, 911, 938, 934, 939, 707; 198/607, 638

[56] References Cited

U.S. PATENT DOCUMENTS

| | | | |
|---|---|---|---|
| 2,809,865 | 10/1957 | Earnshaw | 198/638 X |
| 2,915,180 | 12/1959 | McGillivray | 209/911 X |
| 4,262,806 | 4/1981 | Drabs | 209/577 |
| 4,276,983 | 7/1981 | Witmer | 209/587 |
| 4,371,081 | 2/1983 | Satake | 209/580 |
| 4,848,590 | 7/1989 | Kelly | 209/639 X |
| 4,889,241 | 12/1989 | Cogan | 209/552 |
| 5,135,114 | 8/1992 | Satake et al. | 209/587 X |
| 5,297,667 | 3/1994 | Hoffman | 198/493 |
| 5,305,894 | 4/1994 | McGarvey | 209/580 |
| 5,538,142 | 7/1996 | Davis et al. | 209/580 |

FOREIGN PATENT DOCUMENTS

| | | |
|---|---|---|
| 5-146764 | 6/1993 | Japan . |
| 5-169037 | 7/1993 | Japan . |
| 6-47350 | 2/1994 | Japan . |

*Primary Examiner*—William E. Terrell
*Assistant Examiner*—Tuan Nguyen
*Attorney, Agent, or Firm*—Darby & Darby

[57] ABSTRACT

A grain sorting apparatus includes a conveyor belt mechanism for conveying grains, fed by a feed mechanism onto a conveying surface separately from each other at an upstream region with respect to a conveying direction, to a downstream end so that the grains are discriminated and sorted by a discriminating mechanism and a sorting mechanism when dropping from the downstream end along a predetermined path, the belt mechanism being disposed so that the conveying surface thereof declines as going downstream with respect to the conveying direction to prevent the grains being carried by the belt mechanism from rolling toward the upstream direction on the conveying surface of the belt mechanism. It is therefore possible to prevent the grains from rolling on the conveying surface of the conveyor belt mechanism toward the upstream direction relative to the conveying surface of the conveyor belt even when a conveying velocity of the conveyor belt mechanism is high.

10 Claims, 3 Drawing Sheets

GRAIN SORTING APPARATUS

FIELD OF THE INVENTION

The present invention relates to a grain sorting apparatus which sorts grains or granular articles according to difference in characteristic of the grain such as color, and more particularly, to a grain sorting apparatus having an improved raw grain feed device.

Herein, "grain" or "granular article" means "the one having a two- or three-dimensional form, shape or configuration which is likely to be rolled on a conveying surface in a direction opposite to the conveying direction when it is conveyed horizontally at high speed by conveyor means such as a conveyor belt in a condition of being put alone on the horizontal conveying surface of the conveyor means", examples of which include nuts having a circular cross section such as peanut, beans such as coffee bean, and plastic pellets.

RELATED ARTS

As for the grain sorting apparatus, grain color sorting apparatuses disclosed in JP-A-5-169037, JP-A-5-146764 and JP-A-6-47350 are known.

A conventional grain color sorting apparatus 100 of this kind is equipped with, as shown in FIG. 4, a conveyor belt 107 comprising a pair of rollers 101, 102 of a same diameter and an endless belt 103, extended between the pair of rollers 101, 102, for circulating in a direction A, and serving to convey granular articles 105 put on a turnup horizontal conveying surface 104 of the endless belt 103 to a discriminating and sorting section 106 at a fixed velocity U1. The granular articles 105 arrived at a downstream end 107*a* of the conveyor belt 107 drop from the downstream end 107*a* along a substantially fixed path or trajectory as shown by phantom line 108, passing through a discriminating and sorting zone P of the discriminating and sorting section 106. In the discriminating and sorting section 106, color of the granular article 105 passing through the discriminating and sorting zone P is detected by an optical color detecting section 109 and, further, it is judged by a judging device 110 formed by a device such as a microcomputer whether or not the color of the granular article 105 detected by the optical detecting section 109 is a predetermined color of a predetermined granular article 105*a*. As the judging device 110 produces a discrimination signal Q corresponding to the result of judgement, an air ejector 111 may be operated in response to the discrimination signal Q so that a discolored granular article 105*b* in the granular articles 105 is moved out of the path 108 to be separated and sorted from the predetermined granular articles 105*a*.

The granular articles 105 are fed onto the conveying surface 104 separately or individually from each other by a dispersion feeder 112 at a region 107*b* of the conveyor belt 107 located on the upstream side with respect to the conveying direction A.

In case of feeding the granular article 105 from the dispersion feeder 112 to the conveyor belt 107, the granular article 105 dropped and fed to the region 107*b* of the conveying surface 104 of the conveyor belt 107 cannot be stationary in some cases with respect to the conveying surface 104 but bounces and rolls thereon in some cases, owing to the difference between a velocity U2 at which the granular article 105 is conveyed by the dispersion feeder 112 and a velocity U1 at which the granular article 105 is conveyed by the conveyor belt 107. In such case, the granular article 105 continues moving with respect to the conveying surface 104 until it reaches the downstream end 107*a* of the conveyor belt 107, and accordingly the path or trajectory of the granular article 105 dropping from the downstream end 107*a* swerves from the predetermined path 108, giving rise to an apprehension that discrimination of color of that granular article 105 is hardly performed with reliability.

Further, in the case of the grain sorting apparatus 100, the diameter of the downstream roller 102 which defines the downstream end 107*a* of the conveyor belt 107 is the same as that of the upstream roller 101 and relatively large, and therefore the granular article 105 having arrived at the downstream end 107*a* of the conveyor belt 107 moves along an arc with a relatively large radius (or small curvature), defined by the diameter of the downstream roller 102, and accordingly the granular article 105 is hard to leave from the surface of the conveyor belt 107. As a result, the dropping path 108 of the granular article 105 is hard to be fixed or constant. More specifically, as shown in FIG. 5 (in exaggeration for easy understanding), there is an apprehension that the granular article 105A leaving and dropping early from the conveyor belt 107 (after only moving a bit along the arc of the downstream end 107*a*) and the granular articles 105B, 105C leaving and dropping from the conveyor belt 107 relatively late (after moving a certain distance along the arc of the downstream end 107*a*) have different paths 108A, 108B and 108C, respectively.

On the other hand, in U.S. Pat. No. 5,297,667 which discloses a technology on a system for stabilizing bulk articles (such as raw or processed fruit, vegetables, wood chips and recycled plastics) on conveyor, there is mention of an automated bulk optical processing system 120 as bulk article sorting apparatus, which comprises an infeed system 123 having a curved chute 121 down which articles slide to be accelerated to about a speed of a conveyor belt 122, as well as an upstream roller 125 which defines the upstream end of a conveying surface 124 of the conveyor belt 122 and a downstream roller 126 having a diameter smaller than that of the upstream roller 125, as schematically shown in FIG. 6.

In the bulk article sorting apparatus 120 disclosed in U.S. Pat. No. 5,297,667, a velocity U3, at which a bulk article 128 is fed onto the conveying surface 124 of the conveyor belt 122, is substantially equalized by the acceleration chute 121 to a circulating velocity U1 of the conveying surface 124 of the conveyor belt 122 in a direction A, and therefore there is little fear that the bulk article 128 dropped and fed to the conveying surface 124 of the conveyor belt 122 is not stationary with respect to the conveying surface 124 but bounces and rolls thereon. Further, in the bulk article sorting apparatus 120, the downstream roller 126 of the conveyor belt 122 has a diameter considerably smaller than that of the upstream roller 125, and therefore the bulk article 128 can leave relatively easily from almost the same region at the downstream end of the conveyor belt 122 defined by the downstream roller 126. As a result, the path or trajectory of the bulk article 128 dropping from the downstream end tends to be fixed or constant more reliably.

In the case where the bulk article to be sorted is the granular one which is liable to roll, e.g., the one having a spherical three-dimensional form or the one having a substantially circular cross section, there is an apprehension that a part of the bulk articles 128 may roll on the horizontally extended conveying surface 124 up stream, i.e. in a sense A1 of the conveying direction A. In this case, there is a fear that the path of the bulk article 128 dropping from the downstream end of the conveyor belt 122 is not fixed. This tendency of bulk article 128 to roll in the direction A1 becomes more remarkable as the conveying velocity U1 of the conveyor belt 122 increases.

To cope with this, in the bulk article sorting apparatus 120 disclosed in U.S. Pat. No. 5,297,667, in order to prevent the bulk article 128 from rolling in the direction A1 at the time of transferring the bulk article 128 from the accelerating chute 121 to the conveyor belt 122 and at the time of carrying the bulk article 128 on the conveyor belt 122 so as to make the bulk article 128 disposed on the conveying surface 124 of the conveyor belt 122 stationary thereto, it is proposed to provide a supply source (or a plenum chamber) 130 of fluid such as compressed air and a passage (or a tunnel) 131 of this fluid as stabilizing means so as to form an adjustable forced flow of fluid along the conveying surface 124 of the conveyor belt 122.

However, provision of such fluid flow forming means will bring about the complication and enlargement of the whole apparatus. Moreover, in case that the granular articles are relatively small ones or considerably uneven in shape, for example, there is an apprehension that it is not always easy to stabilize, with respect to the conveying surface, the granular articles by such fluid flow.

SUMMARY OF THE INVENTION

The present invention was developed in view of the above points, and an object thereof is to provide a grain sorting apparatus which is ensured to be capable of preventing grain from rolling on a conveying surface of conveyor belt means toward an upstream direction relative to the conveying surface of the conveyor belt even when a conveying velocity of the conveyor belt means is high.

According to the present invention, the above object can be achieved by a grain sorting apparatus comprising: conveyor belt means, having a pair of rollers and an endless belt extended between the pair of rollers, for carrying grains on a turnup conveying surface of the endless belt; feed means for feeding the grains separately or individually onto the conveying surface at an upstream region of the conveyor belt means with respect to a conveying direction; discriminating means for discriminating grains carried by the conveyor belt means to drop, along a predetermined path, from a downstream end of the conveyor belt means defined by a downstream roller of the pair of rollers; and sorting means for sorting the grains according to result of discrimination by the discriminating means, wherein the conveyor belt means is disposed or arranged so that the conveying surface thereof declines as going downstream with respect to the conveying direction to prevent the grains being carried by the belt means from rolling toward the upstream direction on the conveying surface of the belt means.

In a grain sorting apparatus of the present invention, the conveyor belt means is disposed so that the conveying surface thereof declines as going downstream with respect to the conveying direction, and therefore even if the grain is conveyed at high speed by the conveyor belt means in order to perform the sorting of grain at high speed, it is ensured to prevent or avoid the grain being conveyed by the conveyor belt means from rolling on the conveying surface of the belt means toward the upstream direction relative to the conveying surface. Accordingly, the grain can be conveyed to the downstream end of the conveyor belt means while being stationary with respect to the conveying surface on the conveyor belt means, and therefore the grain can drop or fall from the downstream end along a substantially fixed or constant path. As a result, a degree of accuracy or exactitude with which the dropping grain is discriminated by the discriminating means can be increased, and therefore the degree of reliability with which the dropping grain can be sorted by the sorting means can be also enhanced.

Herein, "conveyor belt means" refers to an endless belt and a driving mechanism therefor. The endless belt can have any shape and/or structure so far as it is formed in a substantially closed loop so as to be circulated and can convey the grain by its outer surface.

Further, "feed means" refers to a device or a mechanism which is capable of feeding or supplying the grains to the conveyor belt means substantially separately or individually from each other. The feed device or mechanism can have any mechanical or/and electrical structure so far as it can feed or supply the grains separately or individually from each other in practice.

Moreover, "discriminating means" refers to an optical, electric, electromagnetic or/and mechanical device which can discriminate whether or not the grain is the predetermined one. In case of directly discriminating the color of the grain, the discriminating device may be of a type which converts optical information about color of the grain into information of electrical or any other form, although the device has more or less an optical section.

In addition, "sorting means" refers to a device which sorts the grains dropping or falling from the downstream end of the conveyor belt means along the predetermined path or trajectory in accordance with whether the grain is a good one or not. Any principle or structure of exerting force can be adopted so far as the device can exert a force on the dropping grain for the sorting.

In a grain sorting apparatus of the invention, it is preferred that inclination of the conveying surface is not greater than a rest angle of the grain carried on the conveying surface. In this case, there is little fear that the grain may roll on the conveying surface to drop therefrom irrespective of the state of circulating movement or drive of the conveyor belt means, e.g., even if the circulating movement or drive of the conveyor belt means is suspended or stopped.

Further, in a grain sorting apparatus of the invention, it is preferred that the downstream roller of the pair of rollers has a diameter smaller than that of the upstream roller which defines an upstream end of the conveying surface. In this case, the grain leaves relatively easily from the downstream end of the conveyor belt means defined by the downstream roller, and therefore the path or trajectory of the grain dropping from the downstream end is ensured to become more fixed or constant.

Moreover, in a grain sorting apparatus of the invention, it is preferred that the feed means comprises a vibrating feed trough for forwarding the grain by vibration and an accelerating chute for accelerating the grain released from a downstream end of the vibration feed trough and throwing the same to the upstream region of the conveying surface of the conveyor belt means. In this case, a velocity, at which the grain is fed to the conveying surface of the conveyor belt means, is substantially equalized by the accelerating chute to the velocity at which the conveying surface of the conveyor belt means circulates in the conveying direction, and therefore it is possible to restrain a fear that the grain dropped and fed from the accelerating chute onto the conveying surface of the conveyor belt means bounces and rolls on the conveying surface. It is still preferred that the accelerating chute is so constructed as to be adjustable in inclination thereof.

In a grain sorting apparatus according to a preferred embodiment of the invention, the discriminating means comprises an optical color sensor for optically detecting the color of the grain and a judging device for judging whether or not the color (tint) detected by the color sensor is a predetermined color and producing a discrimination signal corresponding to a result of judgement, and the sorting means has an ejector operative in response to the discrimination signal from the judging device to change the dropping path or trajectory of the grain.

In a grain sorting apparatus according to a preferred embodiment of the invention, the inclination of the conveying surface is unchanged or constant or the same substantially all over the conveyor belt means in the conveying direction.

However, under certain circumstances, the inclination of the conveying surface may be adjustable in at least a part thereof in the conveying direction or different between the upstream region and a region adjacent to the downstream end, instead of being unchanged or constant.

The foregoing and other objects, features and advantages of the invention will be made clearer hereafter from detailed description of preferred embodiments with reference to attached drawings.

DETAILED DESCRIPTION OF PREFERRED EMBODIMENTS

Description will be given of a grain color sorting apparatus 40 with reference to FIG. 1 for a preferred embodiment of the grain sorting apparatus according to the present invention.

Figure 1:
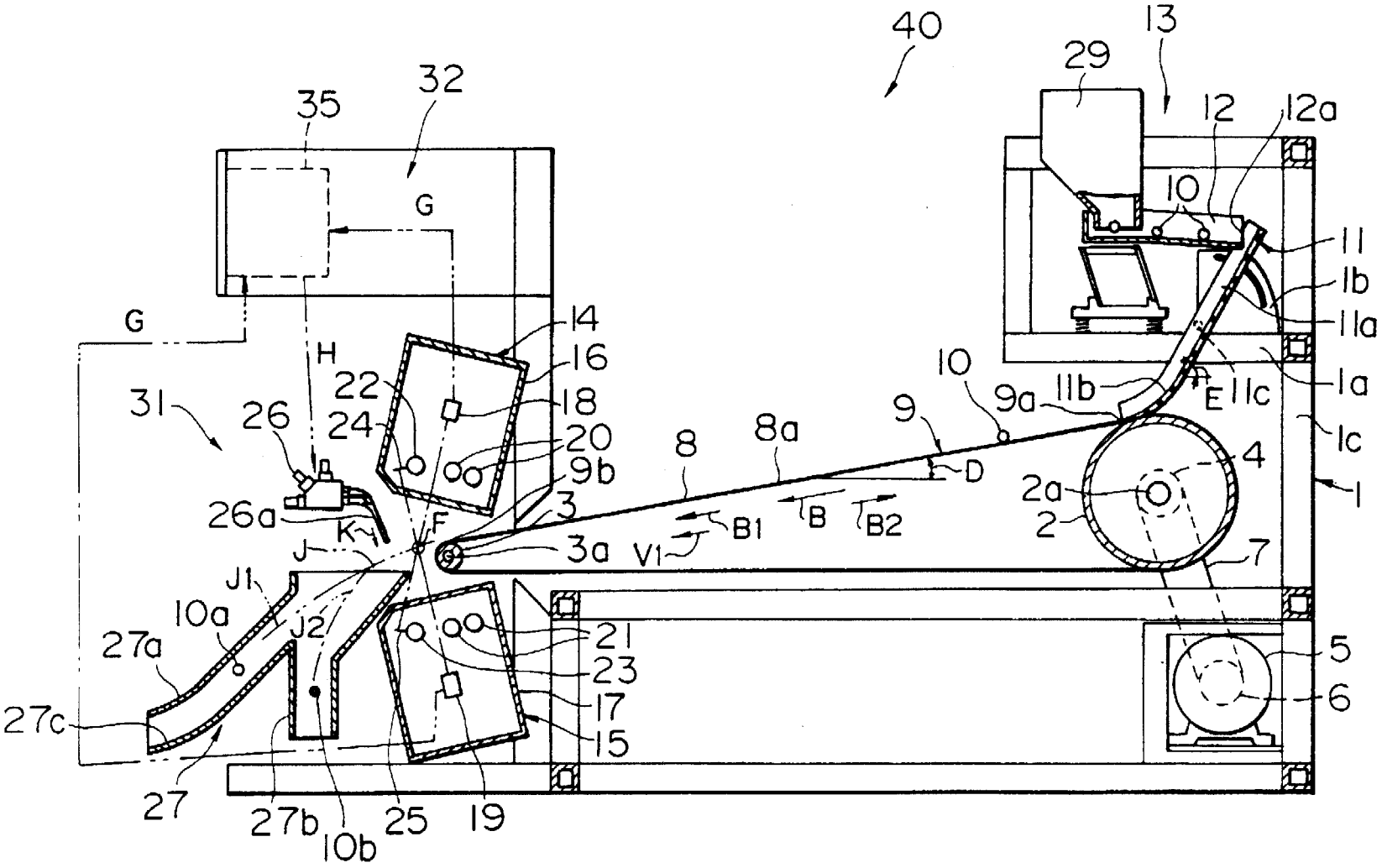
FIG. 1 is a sectional view of a grain sorting apparatus according to a preferred embodiment of the present invention.

In FIG. 1, on a frame 1 of the apparatus 40, a large diameter upstream roller 2 and a small diameter downstream roller 3 are supported so as to be rotatable about their respective horizontal shafts 2*a*, 3*a*. A pulley 4 is fixed on the shaft 2*a* of the large diameter roller 2 so as to be coaxial with the roller 2. A V-belt 7 is extended between the pulley 4 and another pulley 6 on an output shaft of a motor 5 so as to connect them. A wide endless belt 8 is extended between the large diameter roller 2 and the small diameter roller 3. The endless belt 8 is driven to circulate in a direction B (or counterclockwise in FIG. 1) by the motor 5 through the pulleys 4, 5 and the V-belt 7. A conveyor belt device 9 as the conveyor means includes the upstream and downstream rollers 2, 3 in addition to the endless belt 8. A turnup conveying surface 8*a* of the endless belt 8 declines as going downstream along the conveying direction B1. An inclination D of the conveying surface 8*a* is not greater than a so-called rest angle of sorted grain 10, which is the object or article to be conveyed, and is decided according to kind of the grain 10 and velocity V1 at which sorted grain 10 is conveyed on the conveying surface 8*a* in the direction B1 (i.e., circulating speed of the endless belt 8 in the direction B). The inclination D is preferably about 10 degrees in a case where the grain is bean or peanut, for example.

When it is intended to change the inclination D of the conveying surface 8*a*, the shaft 2*a* of the upstream roller 2, which may be so supported by the frame 1 as to be adjustable in vertical position thereof, may be adjusted in its vertical position on the frame 1, or a diameter of the upstream roller 2 (and the endless belt 8 if necessary) may be changed. In this case, it is advisable that an accelerating chute 11, which is to be described in detail later, may also be supported by the frame 1 so as to be adjustable in vertical position thereof, if necessary.

Above the large diameter upstream roller 2, a vibrating feed trough 12 which forwards the grain 10 by the vibration thereof is mounted to the frame 1. The accelerating chute 11 supported by the frame 1 is provided at a downstream end 12*a* of the vibrating feed trough 12. A transferring surface 11*a* of the accelerating chute 11 is slanted in the greater part thereof in the same direction as the conveying surface 8*a* of the belt 8 and at an angle E greater than that D of the conveying surface 8*a*, and moreover it is bent in an arcuate shape at a lower end portion 11*b* thereof so that grain 10 can be transferred smoothly from the accelerating chute 11 to the conveying surface 8*a* of the belt 8 (that is, the transferring surface 11*a* of the accelerating chute 11 connects with the conveying surface 8*a* substantially smoothly). The accelerating chute 11 is attached to a support member 1*b* fixed to a rack 1*a* of the frame 1 so as to be rotatable or pivotal about a support shaft 11*c* in order that the inclination E thereof can be adjusted. If desired, the rack 1*a* of the frame 1 can be made adjustable in its vertical position with respect to a post 1*c* of the frame 1 so that the accelerating chute 11 can be also supported by the frame 1 so as to be adjustable in its vertical position.

Feed means 13 comprises the vibrating feed trough 12 and the accelerating chute 11 which accelerates the grain 10 delivered from the downstream end 12*a* of the vibrating feed trough 12 and releases the same at an upstream area 9*a* of the conveying surface 8*a* of the conveyor belt device 9 with respect to the conveying direction B1. This kind of feed means is well known and details thereof is available by making reference per se to, for example, U.S. Pat. No. 5,297,667 and/or U.S. Pat. No. 4,889,241 incorporated herein by reference thereto.

On the other hand, in the vicinity of the small diameter roller 3 which defines a downstream end 9*b* of the conveyor belt device 9, a pair of optical color sensors or detectors 14, 15 are arranged. The pair of optical color sensors 14, 15 are mounted to the frame 1 so as to interpose the small diameter roller 3 between them.

The optical color sensors 14, 15 respectively comprise cases 16, 17 secured to the frame 1, and photosensors 18, 19, light sources 20, 21, 22, 23 and background members 24, 25 which are provided within and attached to the cases 16, 17 so as to be adjustable in position. The photosensors 18, 19 are arranged to face toward a detection or discrimination area F so as to sense the light from the area F which forms a part of a path or trajectory J of the grain 10 to be sorted when it is released and dropped from the downstream end 9*b* of the conveyor belt means 9. The background members 25, 24 are arranged to face to corresponding photosensors 18, 19, respectively, with the discriminating area F interposed therebetween. Further, the light sources 21, 20 are arranged in those positions corresponding to the photosensors 18, 19, in order to shine or illuminate the light on the grain 10 so that the color of the grain 10 passing through the discriminating area F can be sensed by the photosensors 18, 19. The light sources 22, 23 are provided for illuminating the background members 24, 25 at an adjustable intensity, in order to regulate the amount of light from the corresponding background members 24, 25, respectively.

The optical color sensors 14, 15 per se are well known by those skilled in the art and detailed structure thereof is available by making reference to, for example, U.S. Pat. No. 4,371,081 incorporated herein by reference thereto.

In the vicinity of the optical color sensors 14, 15, e.g., above the same, a controller 35 is provided as judging means for judging whether or not the color sensed by the photosensors 18, 19 is a predetermined color corresponding to the color of a predetermined granular article 10*a*. The controller 35 judges whether or not a color signal G from the photosensors 18, 19 is a predetermined signal. When it is judged that the color signal G is a signal indicative of a granular article 10*b* of foreign matter (or of different color), that is, the color signal G is not the predetermined color signal indicative of the predetermined granular article 10*a*, the controller 35 produces a signal H for operating a sorting or separating means 31. Discriminating means 32 comprises the optical color sensors 14, 15 and the controller 35. The controller 35, per se, which serves as judging device, is well known by those skilled in the art and detailed structure thereof is available by making reference to U.S. Pat. No. 4,262,806, for example, incorporated herein by reference thereto.

An air ejector 26, constituting the sorting or separating means 31 in cooperation with a compressed or pressurized air source which is not shown, is arranged adjacently to the optical color sensor 14 so that a nozzle 26*a* thereof is directed to the path J on the downstream side of the discriminating area F. Below the air ejector 26 is provided a grain discharge chute 27. The grain discharge chute 27 has a good article discharge chute portion 27*a* adapted to include therein an extension J1 of the path or trajectory J and extending on the slant so as to receive the predetermined grain 10*a*, and a defective article discharge chute portion 27*b* branching off from the good article discharge chute portion 27*a* and extending so as to swerve from the extension J1 of the path J in the direction of flow of the air ejected from the nozzle 26*a* of the ejector 26. When the air ejector 26 receives an operation or actuation signal H from the controller 35, a solenoid valve (not shown) of the air ejector 26 is opened to allow the compressed or pressurized air from the compressed air source (not shown) to pass through the solenoid valve and to be ejected from the nozzle 26*a* in a direction K, and accordingly a defective (non-predetermined) granular article 10*b* is swerved from the path J1 and sent to the defective article discharge chute portion 27*b* along a path or trajectory J2, for example. The path J2 doesn't need to be strictly defined so far as it extends in the defective article discharge chute portion 27*b*.

The good article discharge chute portion 27*a* is bent in such a manner that a lower end portion 27*c* thereof is made convex downward.

The air ejector 26 per se, serving as a sorter, is well known by those skilled in the art and detailed structure thereof is available by making reference to U.S. Pat. No. 5,305,804 and/or U.S. Pat. No. 4,276,983, for example, incorporated herein by reference thereto.

Description will now be given of operation of the grain color sorting apparatus 40 having the above construction when the apparatus 40 is used in sorting peanut with inner skin for the raw grain 10.

In the first place, the inclination D of the conveyor belt device 9 and the inclination E of the accelerating chute 11 (and the vertical position thereof if necessary) are selected or adjusted (if adjustable) to take the predetermined or desired values.

Peanuts 10 fed from a hopper 29 to the vibrating feed trough 12 are vibrated by the vibrating feed trough 12 to flow down along the feed trough 12 while being dispersed, and supplied from the downstream end 12*a* to the accelerating chute 11 separately or individually from each other at a substantially constant flow rate (articles/time). The peanuts 10 supplied to the accelerating chute 11 are accelerated to a velocity corresponding to the inclination E of the accelerating chute 11 and, after passing through the arcuate lower end portion 11*b* of the chute 11, transferred from the accelerating chute 11 to the upstream area 9*a* of the endless belt 8 in substantially the same direction as the moving direction B1 of the conveying surface 8*a* of the belt 8 at a velocity V2 which is substantially the same as the circulating velocity V1 of the belt 8 driven to circulate by the roller 2 which in turn is driven by the motor 5 through the pulleys 5, 4 and the V-belt 7 (preferably, $V2 \leqq V1$). Accordingly, with the circulating movement of the conveying surface 8*a* in the direction B, peanuts 10 are conveyed in the direction B1 at the velocity V1 (e.g., 3 m/sec) in a substantially stationary state with respect to the belt 8 without bounding and tumbling or rolling at the upstream area 9*a* of the conveying surface 8*a* of the belt in practice.

The conveying surface 8*a* declines as going downstream. Therefore, on the occasion of circulating movement of the belt 8 in the direction B, even if a force such as air resistance, which tends to roll the peanut 10 backward in a direction B2 opposite to the conveying direction B1, acts on the peanut 10 on the conveying surface 8*a* in response to the moving velocity V1 of the conveying surface 8*a* of the belt 8, there is little fear that the peanut 10 is rolled in the direction B2. In consequence, it becomes possible to increase the moving velocity V1 of the conveying surface 8*a* of the belt 8 so as to speed up the sorting process of the color sorting apparatus 40 for the peanut 10 which is the granular article. Meanwhile, the inclination D of the conveying surface 8*a* is smaller than the rest angle. Therefore, so far as the circulating velocity V1 of the belt 8 in the direction B is not rapidly reduced or decreased, there is no fear that the peanut 10 rolls in the direction B1 along the conveying surface 8*a* of the belt 8 down the stream with respect to the conveying direction even if the circulating velocity V1 of the belt 8 is low (or even if the belt 8 is not moving in an extreme case). Accordingly, with the circulating movement of the belt 8 in the direction B, the peanut 10 is conveyed in the direction B1 at the velocity V1 in a substantially stationary state with respect to the belt 8 to reach the downstream end 9*b*, from which the peanut 10 drops along the predetermined path J.

The downstream end 9*b* of the belt 8 is defined by an outer periphery of the small diameter roller 3 having a large curvature, and therefore the peanut 10 can be released, in practice, from a fixed position or point (in the front view of FIG. 1) of the downstream end 9*b* of the belt 8 at a substantially fixed angle D and at a substantially fixed speed V1, and accordingly the path or trajectory J along which the peanut 10 is released and dropped from the conveyor belt device 9 is substantially fixed or same at all times. In consequence, the peanut 10 passes through the detecting or discriminating area F along the path J without fail.

When passing through the discriminating area F along the path J, the peanut 10 is discriminated by the optical color sensors 14, 15 and the controller 35 whether or not it is a good peanut 10*a* of the predetermined color, for example. When it is discriminated that the peanut 10 is a good article 10*a*, the good peanut 10*a* drops to the good article discharge trough portion 27*a* along the extension J1 of the path J. The good article discharge trough portion 27*a* is bent in such a manner that the lower end portion 27*c* thereof is made convex downward, and therefore the discharge speed of the good peanut 10*a* discharged from the lower end portion 27*c* can be reduced at the lower end portion 27*c*, and accordingly there is little fear that the good peanut 10*a* discharged from the good article discharge trough portion 27*a* is scattered. On the other hand, when it is discriminated that the peanut 10 is a defective article 10*b* at least a part of which is discolored by mold or bruise, for example, or when it is discriminated that the granular article 10 passed through the discriminating area F is a foreign matter (i.e., a defective article) 10*b* other than peanut, the controller 35 produces the signal H to operate or actuate the air ejector 26. Accordingly, owing to the air flow ejected from the nozzle 26*a* of the air ejector 26 in the direction K, the defective article 10*b* is moved out of the extension path J1 to the branch path J2 to drop to the defective article discharge trough portion 27*b* along the path J2.

As seen from the above, in the grain color sorting apparatus 40, the granular articles 10 can drop along the predetermined path J without fail, and therefore the granular articles 10 can be sorted into good ones 10*a* and defective ones 10*b* with reliability.

The above description has been made about a case where the rollers for deflecting the endless belt 8 comprise only two rollers, that is, the upstream and downstream rollers 2, 3, and however, at least one additional deflection roller may be provided at an intermediate position of the conveying surface 8*a* of the endless belt 8.

Figure 2:
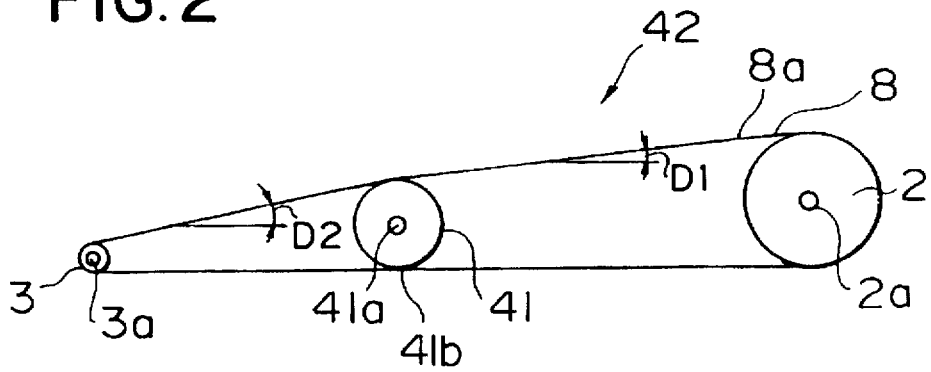
FIG. 2 is a front view of a modification of a conveyor belt means of the apparatus shown in FIG. 1.

More specifically, as shown in, for example, FIG. 2 which is a front view of only a conveyor belt device 42 serving as the conveyor belt means, by providing, in addition to the rollers 2, 3, an intermediate driven or drive roller 41 which is rotatable about an axis of a shaft 41*a* rotatably supported by the frame 1 (not shown in FIG. 2), the conveying surface 8*a* may be inclined at an angle D1 in an upstream region between the rollers 2 and 41 and at an angle D2 (>D1) in a downstream region between the rollers 41 and 3. In this case, the inclination D2 is an angle not greater than the rest angle of the grain to be sorted. The peripheral surface of the roller 41 need not be in contact with the belt 8 at a lower portion 41*b* thereof. Further, at least one more roller such as the roller 41 may be added.

Figure 3:
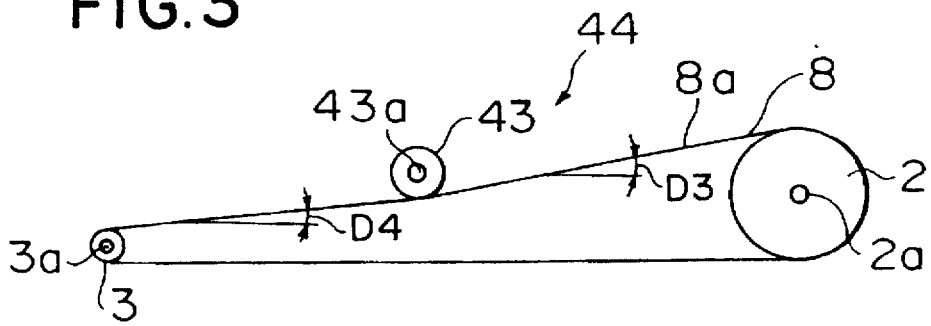
FIG. 3 is a front view of another modification of the conveyor belt means of the apparatus shown in FIG. 1.
Figure 4:
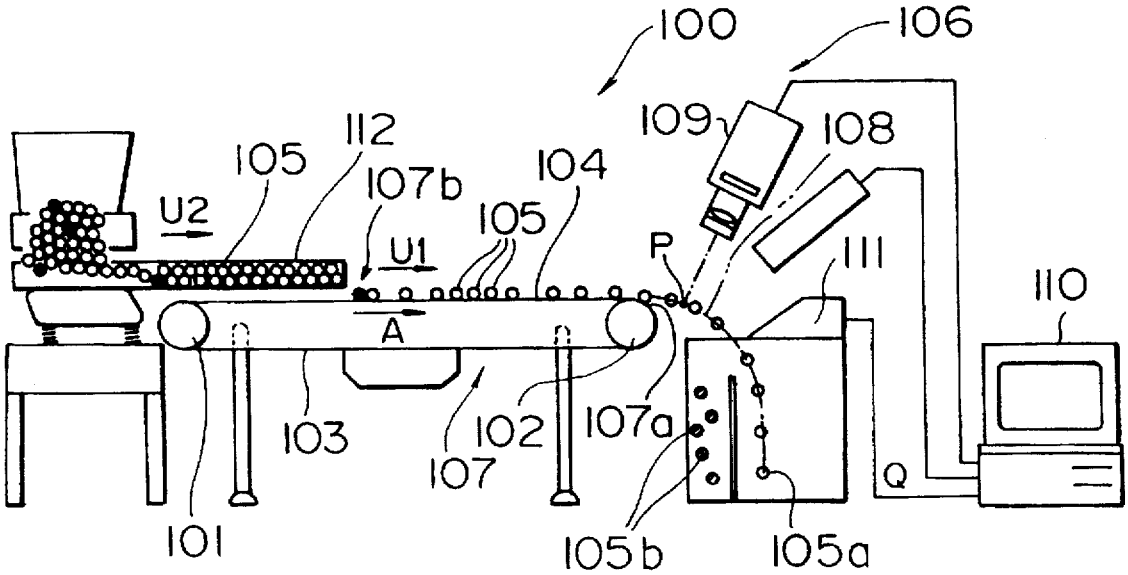
FIG. 4 is a front view of a conventional grain sorting apparatus.
Figure 5:
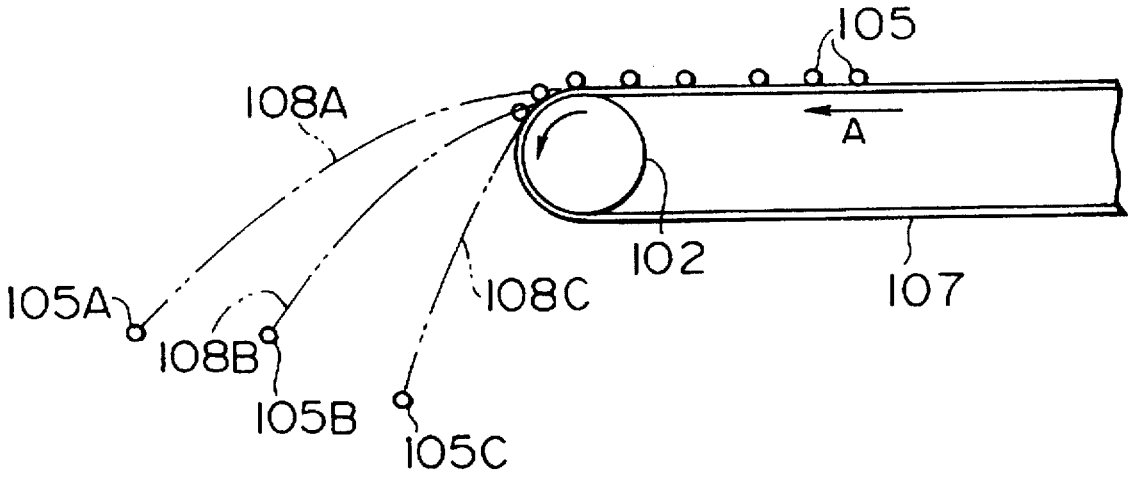
FIG. 5 is an illustration showing how the granular articles leave and drop from the downstream end of the conveyor belt in the apparatus of FIG. 4.
Figure 6:
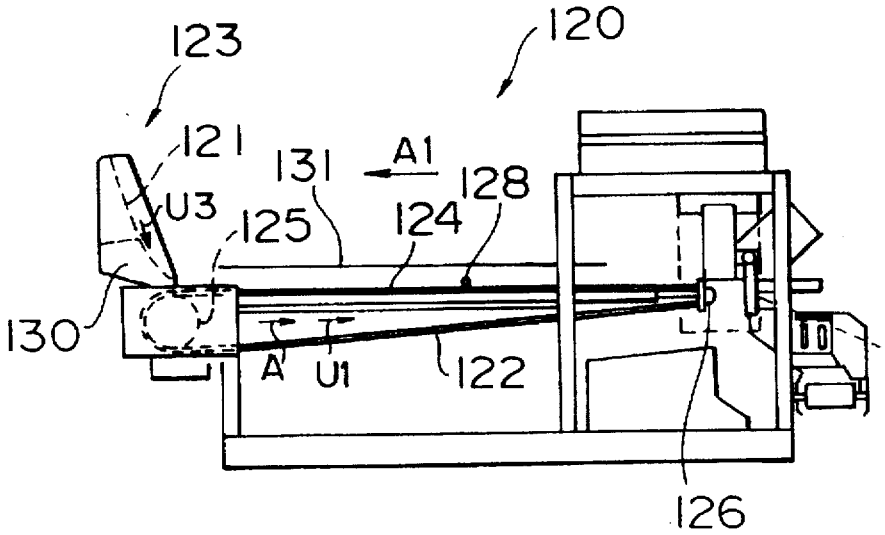
FIG. 6 is a front view of another conventional sorting apparatus.

Moreover, as shown in, for example, FIG. 3 which is a front view of only a conveyor belt device 44 serving as the conveyor belt means, by providing, in addition to the rollers 2, 3, a pair of intermediate driven or drive rollers 43, 43 each of which is rotatable about an axis of a shaft 43*a* rotatably supported by the frame 1 (not shown in FIG. 3), the conveying surface 8*a* may be inclined at an angle D3 in an upstream region between the rollers 2, 43 and at an angle D4 (<D3) in a downstream region between the rollers 43, 3. In this case, the inclination D3 is an angle not greater than the rest angle of the sorted grain. Further, in this case, the pair of short rollers 43 press down the conveying surface 8*a* of the endless belt 8 at opposite end portions of the endless belt 8 in the widthwise direction (or in the direction perpendicular to the drawing sheet of FIG. 3) respectively, while allowing the granular articles to be conveyed on the conveying surface 8*a* through a widthwise middle or central area between the pair of rollers 43, 43. Plural pairs of this kind of rollers may be provided along the conveying direction.

Further, both the roller 41 shown in FIG. 2 and the pair of rollers 43 shown in FIG. 3 may be provided along the conveying surface 8*a*, if desired.

In these cases, it is possible to increase a degree of freedom of the way in which the granular article 10 is accelerated by the accelerating chute 11, for example.

We claim:

1. A grain sorting apparatus for sorting grains having a shape that tends, upon application of a force, to roll over on a conveying surface before sliding, said apparatus comprising:

conveyor belt means comprising a pair of rollers and an endless belt extending between said pair of rollers, for carrying grains on an upwardly facing conveying surface of the endless belt;

feed means for feeding the grains separately onto the conveying surface at an upstream region of said conveyor belt means with respect to a conveying direction;

discriminating means for discriminating the grains carried by said conveyor belt means to drop, along a predetermined path, from a downstream end of the conveyor belt means defined by a downstream roller of said pair of rollers; and sorting means for sorting the grains according to a result of discrimination by said discriminating means, wherein said conveying surface of said conveyor belt means is disposed at an angle of inclination such that the conveying surface declines toward the downstream end of the conveyor belt means, said downstream end being at a elevation lower than the upstream region to prevent the grains being carried by said belt means from rolling in the upstream direction on said conveying surface of said belt means, said angle of inclination is such that the grains being carried by said belt means are stationary relative to the conveying surface when said belt means is stationary and when said belt means is moving at a predetermined velocity.

2. A grain sorting apparatus according to claim 1, wherein said angle of inclination of said conveying surface is not greater than a rest angle of grain carried on said conveying surface.

3. A grain sorting apparatus according to claim 1, wherein said downstream roller of said pair of rollers has a diameter smaller than that of the upstream roller which defines an upstream end of said conveying surface.

4. A grain sorting apparatus according to claim 1, wherein said feed means comprises a vibrating feed trough for forwarding grain by vibration, and an accelerating chute for accelerating grain released from a downstream end of said vibrating feed trough and throwing the same to the upstream region of said conveying surface of said conveyor belt means.

5. A grain sorting apparatus according to claim 4, wherein said accelerating chute is so constructed as to be adjustable in inclination thereof.

6. A grain sorting apparatus according to claim 1, wherein said discriminating means comprises an optical color sensor for optically detecting color of the grain and a judging device for judging whether or not the color detected by the color sensor is a predetermined color and producing a discrimination signal corresponding to a result of judgement, and said sorting means has an ejector operative in response to the discrimination signal from said judging device to change the dropping path of grain.

7. A grain sorting apparatus according to claim 1, wherein said angle of inclination of said conveying surface is unchanged substantially all over the conveyor belt means in the conveying direction.

8. A grain sorting apparatus according to claim 1, wherein said angle of inclination of said conveying surface is adjustable in at least a part thereof in the conveying direction.

9. A grain sorting apparatus according to claim 1, wherein said angle of inclination of said conveying surface is different between the upstream region and a region adjacent to the downstream end with respect to the conveying direction.

10. A grain sorting apparatus in accordance with claim 1, wherein said angle of inclination is such that the grains, upon application of an external force of a predetermined magnitude, will roll with respect to the conveying surface and thereby be prevented from sliding with respect to the conveying surface.

* * * * *

UNITED STATES PATENT AND TRADEMARK OFFICE

CERTIFICATE OF CORRECTION

PATENT NO. : 5,669,511

DATED : September 23, 1997

INVENTOR(S) : Satoru SATAKE et al.

It is certified that error appears in the above-identified patent and that said Letters Patent is hereby corrected as shown below:

Title page, [75], Inventors, change "Higashihiroshima" to --Higashihiroshima-shi--; and change "Mihra" to --Mihra-shi--.

Title page, [30], Foreign Application Priority Date, change "6-270543" to --06-270543--.

Signed and Sealed this

Twenty-third Day of December, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,669,511

DATED : September 23, 1997

INVENTOR(S) : Satoru SATAKE et al.

It is certified that error appears in the above-indentified patent and that said Letters Patent is hereby corrected as shown below:

Title page, [75], Inventors, change " Mihara" to --Mihara-shi--.

Signed and Sealed this

Sixteenth Day of June, 1998

*Attest:*

*Attesting Officer*

BRUCE LEHMAN

*Commissioner of Patents and Trademarks*